United States Patent [19]

Odermann et al.

[11] 4,442,785

[45] Apr. 17, 1984

[54] SEWING MACHINE BOBBIN FOR A VERTICAL AXIS HOOK

[75] Inventors: Charles R. Odermann, Montville; Thaddeus J. Zylbert, Morris Plains, both of N.J.

[73] Assignee: The Singer Company, Stamford, Conn.

[21] Appl. No.: 381,268

[22] Filed: May 24, 1982

[51] Int. Cl.[3] ..... D05B 59/00; D05B 57/04

[52] U.S. Cl. ..... 112/279; 112/228

[58] Field of Search ..... 112/181, 184, 228, 229, 112/230, 231, 279

[56] References Cited

U.S. PATENT DOCUMENTS

| | | | |
|---|---|---|---|
| 699,067 | 4/1902 | Beitzel | 112/229 |
| 3,050,021 | 8/1962 | Fukushima | 112/229 |
| 3,115,855 | 12/1963 | Ketterer | 112/184 |
| 3,138,127 | 6/1964 | Ketterer | 112/184 |
| 3,173,625 | 3/1965 | Creter et al. | 112/231 X |
| 3,175,783 | 3/1965 | Ketterer | 242/118.4 |
| 3,407,760 | 10/1968 | Ketterer | 112/184 |
| 3,693,566 | 9/1972 | Ketterer | 112/184 |
| 3,861,617 | 1/1975 | Davidson et al. | 242/118.4 |
| 4,259,914 | 4/1981 | Johnson | 112/184 |
| 4,326,474 | 4/1982 | Zylbert | 112/184 |

*Primary Examiner*—Wm. Carter Reynolds

*Attorney, Agent, or Firm*—William V. Ebs; Robert E. Smith; Edward L. Bell

[57] ABSTRACT

A sewing machine bobbin for a vertical axis hook is provided with a top and a bottom flanged section, and a fastener which both holds the sections together and is the driven member of a clutch through which the bobbin may be driven for bobbin winding.

7 Claims, 7 Drawing Figures

SEWING MACHINE BOBBIN FOR A VERTICAL AXIS HOOK

DESCRIPTION

BACKGROUND OF THE INVENTION

1. Field of the Invention

The invention relates to sewing machine bobbins, and to bobbin clutching arrangements for operably connecting the bobbin to and disconnecting the bobbin from bobbin winding mechanism.

2. Description of the Prior Art

Mechanisms for use in replenishing thread on a bobbin while in place in the vertical axis looptaker of a sewing machine are well known. Such mechanisms, of which that shown in U.S. Pat. No. 3,693,566 of S. J. Ketterer for "Bobbin Thread Replenishment Mechanism for Sewing Machines" issued Sept. 26, 1972 is an example, are associated with clutching means through which the bobbin may be rotated to cause thread to be wound on the bobbin by a drive shaft. The clutching means has consisted of a driving element and a slot in the structure of the bobbin to receive said element and establish a positive connection between the driving element and the bobbin.

It is a prime object of the present invention to provide an improved construction for a bobbin and bobbin clutching arrangement permitting the use of easily fabricated parts in the bobbin and providing for the assembly of such parts with a fastner which is effective as a clutching member for bobbin winding.

It is another object of the invention to provide an improved bobbin construction and clutching arrangement as described permitting the bobbin parts to be assembled with a commercially available type of screw having a positively engageable slotted end.

It is still another object of the invention to provide an inexpensive, easily fabricated all metal bobbin including a drivable clutching member as an integral part thereof.

Other objects and advantages of the invention will become apparent during a reading of the specification taken in connection with the accompanying drawings.

SUMMARY OF THE INVENTION

In accordance with the invention, a bobbin is provided with a top flanged section and a bottom flanged section. At least one section is provided with a hub portion for holding thread, and each of the flanged sections is formed with a hole on the central axis of the bobbin. The bobbin sections are held together with a clutching member which includes an elongate threaded portion that extends through a hole in the bottom section to engage threads in the hole in the top section, and an enlarged head end portion to engage the bottom section. The threaded clutching member is the drivable member of a clutch which also includes a driving clutch member rotatable by the driving shaft of bobbin winding mechanism. One of the clutch members includes one or more slots wherein the other clutch member is received to establish a driving connection between the members as required for the winding of thread on the bobbin.

DESCRIPTION OF THE INVENTION

Figure 1:
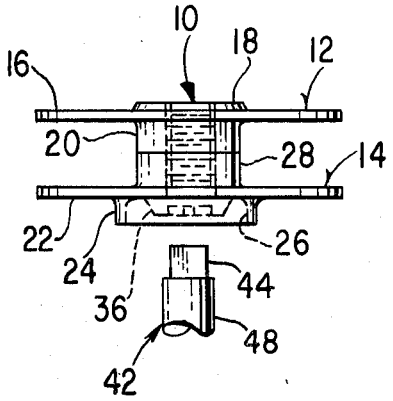
FIG. 1 is a elevational view of a sewing machine bobbin constructed according to the invention.
Figure 2:
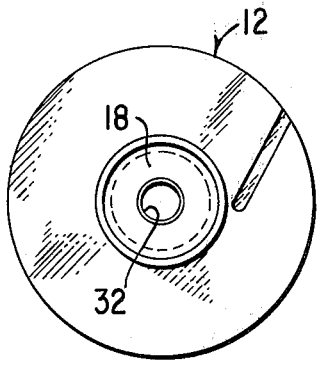
FIG. 2 is a top plan view of the bobbin of FIG. 1.
Figure 3:
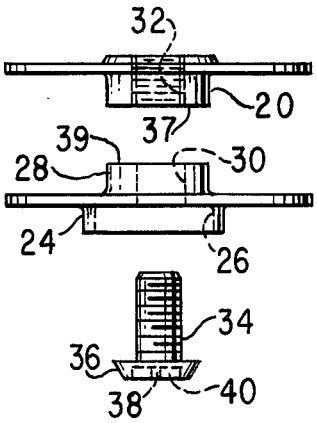
FIG. 3 is a disassembled elevational view of the bobbin of FIGS. 1 and 2.
Figure 4:
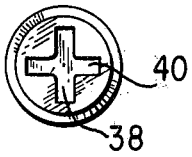
FIG. 4 is an enlarged bottom end view of a drivable clutch member with which the bobbin is provided.

Referring to FIGS. 1 through 5 of the drawings, reference character 10 designates a sewing machine bobbin according to the invention including a top section 12 and a bottom section 14. Section 12 includes a flange 16 with a central crowned portion 18, and further includes a depending hub portion 20. Section 14 includes a flange 22 with a depending central portion 24 which is formed with a recess 26, and includes an upstanding hub portion 28. Bottom section 14 is provided with an unthreaded through hole 30 communicating with recess 26, and top section 12 is provided with a threaded hole 32. The top and bottom sections are assembled with a screw 34 having an enlarged head end portion 36 and an elongate threaded portion extending therefrom, the screw preferably being a Phillips screw with cross slots 38 and 40. Screw 34 holds hub portions 20 and 28 in an abutting relationship at end surfaces 37 and 39 to complete a hub upon which thread may be wound. The screw head is disposed in the assembled bobbin in recess 26 in the depending portion 24 of flange 22. The screw extends through hole 30 in the bottom bobbin section and into threaded engagement with the top section in hole 32.

Screw 34 is a drivable clutch member which is engageable with a driving clutch member 42. As shown, clutch member 42 consists of a key 44 at the end of a driving shaft 48. The shaft is part of bobbin winding mechanism of the kind shown and described, for example, in U.S. Pat. No. 3,639,566 mentioned hereinbefore. Shaft 48 is raised as described in said patent to cause key 44 to project through opening 41 in a rotatable looptaker 43 as well as through an opening 45 in a stationary bobbin case 47 wherein the bobbin is supported for rotation, and enter one or the other of the cross slots 38 and 40 in clutch member 34, and so establish a driving connection between the clutch members as required to have the shaft impart rotation to the bobbin 10 for bobbin winding. Downward movement of the shaft disconnects the shaft from the bobbin. The threads on screw 34 and in threaded hole 32 are directed so as to cause the screw to tighten in the bobbin when turned in the direction in which the bobbin is driven by shaft 48.

Preferably, each of the bobbin sections 12 and 14 is a one-piece metal casting. As such, these parts may be economically produced in an automated zinc die casting machine. The bobbin sections are readily assembled into a completed bobbin with screws 34 in automatically operated machinery.

Figure 6:
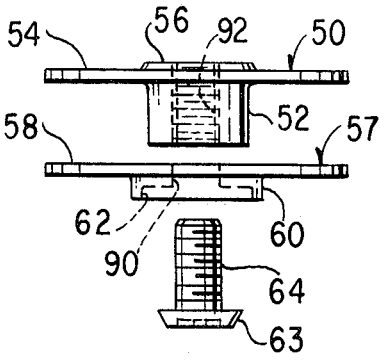
FIG. 6 is a disassembled elevational view showing a modified bobbin construction.

In a modified bobbin construction according to the invention, (see FIG. 6), a top section 50 carries the entire thread carrying hub 52 for the bobbin under a flange 54 including a crown 56. As shown, the bottom section 57 consists of flange 58 with depending portion 60 which is recessed at 62 to receive the slotted head 63 of a screw 64 engageable in unthreaded and threaded holes 90 and 92, respectively for holding the bobbin sections together and rotating the bobbin when clutched to the driving shaft of bobbin winding mechanism.

Figure 7:
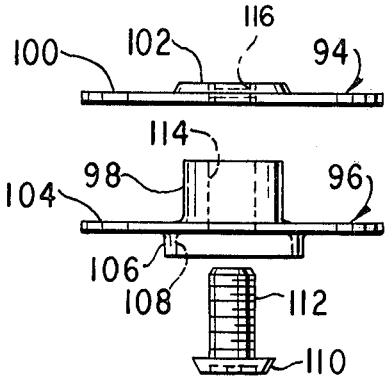
FIG. 7 is a disassembled elevational view showing another modified bobbin construction.
Figure 5:
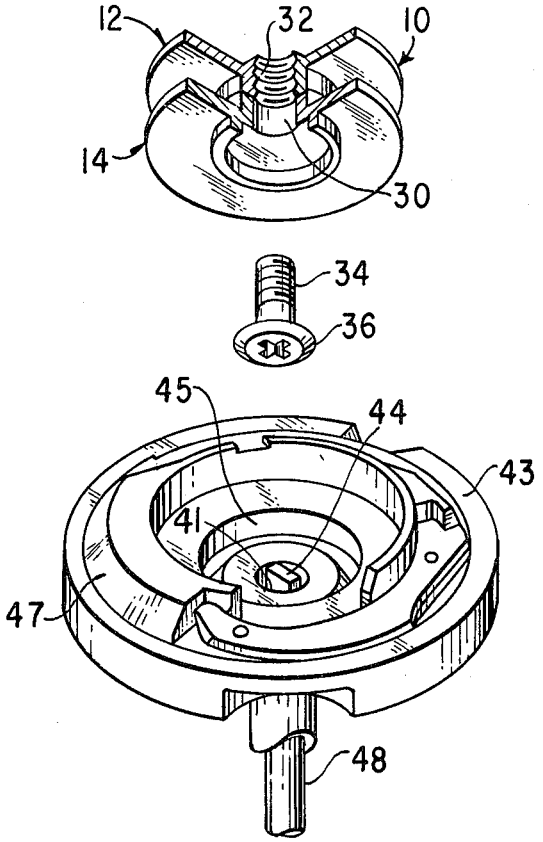
FIG. 5 is an enlarged perspective view showing the bobbin construction and clutching arrangement therefor.

Another modified bobbin construction, as shown in FIG. 7, includes a top section 94 without a hub portion, and a bottom section 96 having the entire hub 98 of the bobbin as a part thereof. The top section includes flange 100 with a crown 102. Bottom section 96 includes, in addition to hub 98, a flange 104 with a depending central portion 106 which is formed with a recess 108 for the slotted head 110 of a screw 112 receivable in unthreaded and threaded holes 114 and 116 in sections 96 and 94, respectively. The screw serves as a means for holding the bobbin sections together and as a drivable element of a clutch through which the bobbin may be rotated for bobbin winding.

It is to be understood that the present disclosure relates to preferred embodiments of the invention which are for purposes of illustration only and is not to be construed as a limitation of the invention. Numerous alterations and modifications of the structures herein disclosed will suggest themselves to those skilled in the art, and all such modifications and alterations which do not depart from the spirit and scope of the invention are intended to be included within the scope of the appended claims.

We claim:

1. In combination, a driving clutch member, and a bobbin rotatable thereby for bobbin winding, the bobbin including a top flanged section and a bottom flanged section at least one of which includes a hub portion upon which sewing thread may be wound and each of which includes a hole on the rotational axis of the bobbin, the bobbin also including a drivable clutch member with an elongate threaded portion which extends through the hole in the bottom section and into threaded engagement with the top section in the hole therein, the drivable clutch member being formed with an enlarged head end portion which engages said bottom section to hold the sections in an assembled relationship, the head end portion of the drivable clutch member including one or more slots wherein the other clutch member is received to establish a driving connection between the clutch members.

2. The combination of claim 1 wherein the drivable clutch member is a Phillips screw.

3. The combination of claim 1 wherein each of the flanged bobbin sections includes a hub portion for sewing thread.

4. The combination of claim 1 wherein only the top flanged bobbin section includes a hub portion for sewing thread.

5. The combination of claim 1 wherein only the bottom flanged bobbin section includes a hub portion for sewing thread.

6. The combination of claim 1 wherein the drivable clutch member screws into the flanged bobbin top section in a direction which is the same as the bobbin winding direction.

7. The combination of claim 1 wherein each of the flanged bobbin sections and the threaded drivable clutch member is a metal part.

* * * * *